United States Patent [19]

Murtaugh

[11] 4,029,607

[45] June 14, 1977

[54] DRAIN CLEANING COMPOSITIONS

[75] Inventor: Justin J. Murtaugh, Guilford, Ind.

[73] Assignee: The Drackett Company, Cincinnati, Ohio

[22] Filed: Feb. 19, 1976

[21] Appl. No.: 659,186

Related U.S. Application Data

[63] Continuation-in-part of Ser. No. 456,431, March 29, 1974, abandoned.

[52] U.S. Cl. ..... 252/545; 252/541; 252/544; 252/546; 252/173; 252/DIG. 11; 252/135

[51] Int. Cl.[2] ..... C11D 3/26; C11D 7/32

[58] Field of Search ... 252/547, 545, 548, DIG. 11, 252/544, 135, 541, 546, 173

[56] References Cited

UNITED STATES PATENTS

| | | | |
|---|---|---|---|
| 3,168,478 | 2/1965 | Stefein et al. | 252/135 |
| 3,454,500 | 7/1969 | Lancashire | 252/547 |
| 3,730,912 | 5/1973 | Inamorato | 252/528 |

*Primary Examiner*—Mayer Weinblatt
*Attorney, Agent, or Firm*—David J. Mugford; George A. Mentis; Samuel J. DuBoff

[57] ABSTRACT

Drain cleaning compositions, especially effective in dissolving soap curd, are provided which comprise in aqueous solution an ammonium, alkylamine, hydroxy-alkylamine, or mixtures thereof, salt of nitrilotriacetic acid, N-2-hydroxyethylimino diacetic acid, an alkylene polyamine polycarboxylic acid, or mixtures thereof, and an ammonium, alkylamine, hydroxy-alkylamine, or mixtures thereof, salt of one or more anionic surfactants, wherein the alkylamine and hydroxy-alkylamine have a chain length of from 1 to 5 carbon atoms, the composition is substantially free of alkali metal ions, and the alkylene polyamine polycarboxylic acid has the formula $$(HOOCCH_2)_2N-[(CH_2)_xNCH_2COOH]_y-CH_2COOH$$

wherein $x$ and $y$ may each independently be from 1 to 4.

8 Claims, No Drawings

DRAIN CLEANING COMPOSITIONS

This application is a continuation-in-part of my copending application, Ser. No. 456,431, filed Mar. 29, 1974, now abandoned.

This invention relates to drain cleaning compositions. More specifically, the invention relates to drain cleaning compositions which are more effective in dissolving soap curd, which causes clogging of a drain, than conventional drain cleaning compositions comprising a large quantity of concentrated acid, caustic, or oxidizing agent.

Drains for household sinks often become clogged by a combination of fatty substances, protein or cellulose fibers, and soap. Soap, although an excellent detergent, has the disadvantage that it reacts with the metallic ions in water to form an insoluble curd. This curd, formed from the calcium and magnesium ions of hard water and soap, together with small amounts of oil, grease, fatty substances from the body, cooking oils, or even hair grooming products, adheres to the inside of the drain and forms a restriction to the free flow of water. In addition, some solid, water-insoluble objects, such as hair, lint, or paper, become lodged in the drain at the point of restriction, so that eventually a clog is formed.

Most conventional drain cleaners composed primarily of concentrated solutions of a strong acid, base, or combination of a strong oxidizing agent and strong base, attack the clogging material lodged in the drain at the restriction. These conventional drain cleaners are effective in removing the clog but do not eliminate the initial problem, i.e. the deposit of soap curd in the drain causing the restriction, which may eventually cause a new clog to be formed.

The drain cleaning compositions of the present invention are advantageous because they dissolve soap curd deposits in the drain, so that no restriction of water flow occurs to allow clogging.

In order to remove soap curd deposits, sequestering agents are utilized, which are well known in the prior art. U.S. Pat. Nos. 2,892,796 and 2,921,908 disclose detergent compositions comprising the alkaline salts of amino polycarboxylates as sequestering agents and organic phosphates, which prevent corrosion by the sequestering agents. U.S. Pat. Nos. 3,308,065; 3,438,811; and 3,447,965 disclose scale removal compositions comprising the ammonia and amine salts of alkylene polyamine polycarboxylic acids as sequestering agents.

U.S. Pat. No. 3,454,500 discloses a fatty acid soap composition comprising a detergent and a water soluble salt of a sequestering agent.

U.S. Pat. No. 3,679,592 discloses a cleaning composition comprising an amine or ammonium salt of a film-forming polymer, a surfactant, and a scale inhibitor or sequestering agent.

U.S. Pat. No. 3,001,945 discloses a liquid detergent composition comprising up to 55% of an amine oxide surfactant and a water soluble aminopolycarboxylate salt.

U.S. Pat. No. 3,730,912 discloses a clothes cleaning detergent composition having a synergistic mixture of a fatty acid, a polyethoxylated quaternary ammonium salt and a high molecular weight amide or amine which provides certain temperature dependent foam characteristics to the composition, which is quite different from that taught by Applicant.

In accordance with this invention, an effective drain cleaning composition is provided by an aqueous solution of an ammonium, alkylamine, hydroxy-alkylamine, or mixtures thereof, salt of nitrilotriacetic acid, N-2 hydroxyethylimino diacetic acid, an alkylene polyamine polycarboxylic acid, or mixtures thereof, and an ammonium, alkylamine, hydroxy-alkylamine, or mixtures thereof, salt of one or more anionic surfactants, wherein the alkylamine and hydroxy-alkylamine have a chain length of from 1 to 10 carbon atoms, the composition is substantially free of alkali metal ions, and the alkylene polyamine polycarboxylic acid has the formula:

$$(HOOCCH_2)_2N-[(CH_2)_xNCH_2COOH]_y-CH_2COOH$$

wherein $x$ and $y$ may each independently be from 1 to 7.

None of the above-discussed references teaches the drain cleaning compositions of the present invention which comprise ammonium, alkylamine, or hydroxy-alkylamine salts of both a sequestering agent and an anionic surfactant, where the compositions are substantially free of alkali metal ions.

Although the present invention should not be limited to any particular theory, it is believed that the drain cleaning compositions of this invention react with soap curd to form a metal complex between the sequestering agent and the calcium or magnesium portion of soap curd. Because this metal complex is soluble in water, the soap curd may then dissolve and be washed down the drain, carrying along with it any other clogging material. However, along with formation of this metal complex, is the formation of the amine salt of the fatty acid portion of soap curd. It is believed that the amine salt forms a lyophilic colloidal system which is soluble in low concentrations. In solutions which are not extremely dilute, however, the salt is colloidal and forms an insoluble lyophilic amine soap gel. This gel forms on the surface of the dissolving soap curd and retards or prevents dissolution of the soap curd and unclogging of the drain. Thus, although the insoluble soap curd can be dissolved by use of the ammonium, alkylamine, or hydroxy-alkylamine salt of the sequestering agent, it is prevented from being dissolved because of the formation of this surrounding insoluble gel.

Incorporation in the drain cleaning compositions of the present invention of an ammonium, alkylamine, or hydroxy-alkylamine salt of an anionic surfactant eliminates the formation of this insoluble lyophilic amine soap gel. It is believed that the salt of the anionic surfactant acts as a coupling agent between the amine salt of the fatty acid portion of the soap curd and water, so that it is more soluble and does not form this insoluble gel on the surface of the dissolving soap curd.

Thus, the ammonium, alkylamine, or hydroxy-alkylamine salt of an anionic surfactant eliminates formation of an undesirable amine soap gel which would prevent dissolution of the soap curd and provides an effective drain cleaning composition, having a pH of from 7 to 10, that is as efficient as conventional drain cleaners having higher caustic, alkali metal hydroxide concentrations.

Further, it has been found that the compositions of this invention are not effective in dissolving soap curd if a substantial amount of alkali metal ions are present. The alkali metal ions prevent this coupling effect of the ammonium, alkylamine, or hydroxy-alkylamine salt of an anionic surfactant, as described above, and allow the insoluble amine soap gel to be formed to prevent dissolution of the soap curd.

In a preferred embodiment of this invention, a drain cleaning composition is provided which comprises from about 0.25% to about 5.0% by weight, of an ammonium, alkylamine, hydroxyalkylamine, or mixtures thereof, salt of a member selected from the group consisting of ethylenediaminetetraacetic acid, nitrilotriacetic acid, N-2-hydroxyethylimino-diacetic acid, or mixtures thereof; from about 0.12% to about 15%, by weight, of an ammonium, alkylamine, or hydroxy-alkylamine, or mixtures thereof, salt of one or more anionic surfactants; and up to about 99%, by weight, of water, wherein the alkylamine and hydroxy-alkylamine have a chain length of from 1 to about 5 carbon atoms and the composition is substantially free of alkali metal ions.

In another preferred embodiment of the present invention, a drain cleaning composition is provided which comprises in aqueous solution from about 0.50% to about 3.0%, by weight, of an ammonium, alkylamine, or hydroxy-alkylamine, or mixtures thereof, salt of a member selected from the group consisting of ethylenediaminetetraacetic acid, nitrilotriacetic acid, N-2-hydroxyethyliminodiacetic acid, or mixtures thereof; from about 0.50% to about 5.0%, by weight, of an ammonium, alkylamine, hydroxy-alkylamine, or mixtures thereof, salts of one or more anionic surfactants; and from about 0.12% to about 5.0%, by weight, of an ammonium, alkylamine, or hydroxy-alkylamine salt of thioglycolic acid, wherein the alkylamine and hydroxy-alkylamine have a chain length of from 1 to 5 carbon atoms and the composition is substantially free of alkali metal ions.

Numerous sequestering agents, those agents which have the capability of chelating or complexing metal ions, are known in the prior art which are useful in the compositions of the present invention. The soluble salts of alkylene polyamine polycarboxylic acids are preferred because of their strong complexing action with calcium and magnesium ions in hard water and those particular salts which are more preferred, have the formula:

$$(HOOCCH_2)_2N-[(CH_2)_xNCH_2COOH]_y-CH_2COOH$$

wherein $x$ and $y$ may be independently from 1 to 7. The salts most preferred are those having the above formula where $x$ and $y$ may each independently be from 1 to 4; nitrilotriacetic acid; and N-2-hydroxyethylimino diacetic acid. Representative of some of the salts of amino polycarboxylates useful in the compositions of this invention are ethylenediaminetetraacetic acid, N-2-hydroxyethylethylene diamine triacetic acid, N-2-hydroxyethyl-nitrilodiacetic acid, ethylene diaminetetraproprionic acid, and diethylenetriamine pentaacetic acid.

The ammonium, alkylamine, hydroxy-alkylamine, or mixtures thereof, salts of thse sequestering agents are preferred in the compositions of this invention: such as, for example, methylamine-, dimethylamine-, ethylamine-, diethylamine-, butylamine-, propylamine-, triethylamine-, trimethylamine-; the corresponding monoethanolamine-, diethanolamine-, triethanolamine-, isopropanolamine-, and propanolamine-salts. Generally, the alkylamine and hydroxy-alkylamine utilized in the compositions of this invention have a chain length of from 1 to 10 carbon atoms, however, those having from 1 to 5 carbon atoms are preferred.

The above-described sequestering agents and amines can be utilized in the compositions of this invention in all combinations, such as, for example, mixing of two or more alkylene polyamine polycarboxylic acids or an alkylamine and a hydroxy-alkylamine without departing from the spirit of this invention.

The minimum quantity of both a sequestering agent and of the salt of the anionic surfactant in the drain cleaning compositions of this invention have been found to be about, respectively, 0.25% and 0.12%. If much less than these amounts is utilized in the compositions, then the insoluble lyophilic gel forms and prevents dissolution of the soap curd. If only slightly lesser amounts are utilized, then the time necessary for dissolution of the soap curd is increased and the amount of soap curd dissolved is decreased. Generally, it has been found that about 5% of the sequestering agent and 15% of the anionic surfactant is sufficient to provide an effective drain cleaning composition. Greater amounts of each of these ingredients can be utilized in these drain cleaning compositions, however, the use of such greater amounts is less economical without significantly increasing the efficiency in drain cleaning of these compositions.

Many surfactants can be utilized in the drain cleaning compositions of this invention, as long as they function as coupling agents, as described above, and add no substantial quantity of alkali metal ions to the compositions. In addition to its unique coupling effect with the sequestering agent to eliminate gel formation, the surfactant provides a penetrating and wetting effect, so as to increase the removal of the clog from the point of restriction and to allow the free flow of water. Also, the surfactant increases the rate at which the composition penetrates soap curd especially when fatty substances are also present.

The surfactant utilized should be present in an amount from about 50% to 300% relative to the concentration of the sequestering agent, however, the maximum amount permissible is dependent only on economics. It has been found that certain non-ionic surfactants are ineffective in the compositions of the present invention and that anionic surfactants are preferred. These may include an ammonium, alkylamine, hydroxy-alkylamine, or mixtures thereof, salt of lauryl sulfate; an ammonium salt of a sulfated linear primary alcohol ethoxylate; a phosphate ester, such as one having the formula:

$$[R-O(CH_2CH_2O)_x]_yP(OH)_{3-y}$$

where $x$ has the value of 1 to 15 and $y$ has the value of 1 to 2, and R is an alkyl or phenalkyl radical, having from 6–150 carbon atoms wherein such phosphate esters are disclosed in U.S. Pat. No. 3,168,478 to Stefcik et al. (e.g. GAFAC anionic surfactants sold by GAF Corporation) and as additionally disclosed at Pages 36 and 37 of the text "Synthetic Detergents" by A. Davidsohn and B. M. Milwidsky published in 1972 by Chemical Rubber Co., 18901 Cranwood Parkway, Cleveland, Ohio 44128; derivatives of sulfo succinic acid, such as dihexylmethyl-amyl sulfo succinic acid; an alkyl aryl sulfonate; alkyl sulfate; or an alkyl ethylene oxide ether sulfate. Again, the above described salts of anionic surfactants can be utilized in the compositions of this invention in all combinations without departing from the spirit of this invention.

Generally, when utilizing a sequestering agent, it is well known to prevent corrosion of metals by the agent with a corrosion inhibitor. A variety of corrosion inhibitors useful in the drain cleaning compositions of this invention are available, as long as the corrosion inhibitor chosen adds no substantial amount of alkali metal ions into the compositions. Most preferred are the ammonium, alkylamine, or hydroxy-alkylamine, or mixtures thereof, salts of thioglycolic acid. The concentration of corrosion inhibitor may vary between zero and 10%, by weight, but from 0.12% to about 5.0%, by weight, of inhibitor is preferred.

Other ingredients, such as urea, are desirable in dissolving hair and other water-insoluble objects which form a clog.

In addition to the foregoing ingredients, the compositions of this invention may also include anti-soil redeposition agents, solubilizers, germicides, and other ingredients conventionally employed in drain cleaning compositions.

The drain cleaning compositions of this invention are prepared by mixing the ingredients, namely, by dissolving the sequestering agent in water and adding the other ingredients until completely dissolved to form a drain cleaning composition having the desired composition. Generally the order of mixing is not critical. However, when acidic surfactants or sequestering agents in the acid form are used, it is better to dissolve the ammonium, alkylamine, or hydroxy-alkylamine or mixtures thereof in the required amount of water before addition of the other ingredients.

In the following examples the drain cleaning compositions were applied to solid soap curd. The soap curd was a mixture of 80% calcium curd and 20% magnesium curd. The soap used to prepare the curds consisted of a mixture of 430.5 gms. of commercially available bar soaps, which were mixed and dissolved in 5 liters of hot water. The calcium and magnesium soap curds were prepared by precipitation from portions of the mixture by adding either calcium chloride or magnesium chloride. The precipitated soap curd was filtered, washed, and mixed at a ratio of 4 parts of calcium curd to one part of magnesium curd. The resulting solid mixture contained 33% soap curd and 67% water. For each test, 5 gms. of the mixed wet curd was pressed into the bottom corner of a beaker. One part of water for each one part of drain cleaning composition was also added so that the composition would be diluted and the test conditions would be similar to the conditions often present with clogged drains.

Effectiveness of the drain cleaning compositions of this invention was determined according to the amount of soap curd dissolved and time necessary to dissolve this amount of curd. All percentages in the Examples are given in terms of percent by weight. Also, the wetting agent used in each Example was one of the following:

| | |
|---|---|
| Wetting Agent (1) | ammonium salt of a sulfated linear primary alcohol ethoxylate |
| Wetting Agent (2) | phosphate ester having the formula $[R-O(CH_2CH_2O)_x]_yP(OH)_{3-y}$ (O) where x has a value of 1 to 15 and y has a value of 1 to 2 and R is an alkyl or phenalkyl radical, preferably a hydrocarbon radical having from 6–150 carbon atoms. |

The specific wetting agents utilized in the following Examples are manufactured and supplied by General Aniline and Film Corporation, New York, New York, and respectively are identified by the names "Alipal-CD-128+ and "GAFAC-RA-600".

EXAMPLE 1

| | Percent |
|---|---|
| Ammonium salt of ethylenediaminetetraacetic acid | .25 |
| Ammonium salt of phosphate ester | .75 |
| Ammonium thioglycolate | .125 |
| Water | 98.875 |

The soap curd was about 50% dissolved after 1 hour and completely dissolved after 2 hours, thereby indicating that the solution was an effective drain cleaning composition.

EXAMPLE 2

| | Percent |
|---|---|
| Ammonium nitrilotriacetic acid | .25 |
| Ammonium salt of phosphate ester | .75 |
| Ammonium thioglycolate | .125 |
| Water | 98.875 |

The soap curd was about 50% dissolved after 1 hour and completely dissolved after 2 hours, thereby indicating that other sequestering agents can be used to formulate an effective drain cleaning composition.

EXAMPLE 3

| | Percent |
|---|---|
| Ammonium salt of ethylenediaminetetraacetic acid | 1.0 |
| Ammonium salt of phosphate ester | .10 |
| Ammonium thioglycolate | 1.0 |
| Water | 97.90 |

After ½ hour the soap curd was coated with a gelatinous film of soap gel and after 8 hours the soap curd was not dissolved because the amount of surfactant coupling agent was less than specified for the drain cleaning compositions of this invention.

EXAMPLE 4

| | Percent |
|---|---|
| Monoethanolamine salt of ethylenediaminetetraacetic acid | 2.0 |
| Monoethanolamine salt of laurylsulfate | 2.0 |
| Water | 96.0 |

The soap curd was about 50% dissolved after 1 hour and completely dissolved after 2 hours, indicating that the hydroxyalkylamine salt of lauryl sulfate acts as a coupling agent to solubilize the monoethanolamine soap — monoethanolamine ethylene—diaminetetraacetic acid gel mixture formed on the surface of soap curd and therefore said solution was an effective drain cleaning composition.

EXAMPLE 5

| | Percent |
|---|---|
| Triethanolamine salt of ethylenediamine-tetraacetic acid | 2.0 |
| Ammonia salt of a sulfated linear primary alcohol ethoxylate | 4.0 |
| Sodium thioglycolate | .5 |
| Water | 93.5 |

The soap curd surface was covered with a hard gelatinous film after 10 minutes contact and very little or no soap curd dissolved in 48 hours, indicating that the solution was not an effective drain cleaning composition because the solution was not essentially free of alkali metal ions.

EXAMPLE 6

| | Percent |
|---|---|
| Diisopropylamine salt of ethylenediamine-tetraacetic acid | 2.0 |
| Monoethanolamine salt of lauryl sulfate | 6.0 |
| Potassium thioglycolate | .5 |
| Water | 91.5 |

The soap curd surface was covered with a gelatinous film after 10 minutes contact and the soap curd did not dissolve in 8 hours, indicating that the solution was not an effective drain cleaning composition because the solution was not essentially free of alkali metal ions.

EXAMPLE 7

| | Percent |
|---|---|
| Diethanolamine salt of ethylenediamine-tetraacetic acid | 1.0 |
| Monoethanolamine salt of a sulfated linear primary alcohol ethoxylate | 3.0 |
| Diisopropylamine thioglycolate | 1.0 |
| Water | 95.0 |

The soap curd was 50% dissolved in 1 hour and completely dissolved in 2 hours, indicating the solution was an effective drain cleaning composition.

EXAMPLE 8

| | Percent |
|---|---|
| Monoethanolamine salt of ethylenediamine-tetraacetic acid | 1.0 |
| Monoethanolamine salt of lauryl sulfate | 0.5 |
| Monoethanolamine salt of thioglycolic acid | 0.5 |
| Water | 98.0 |

The soap curd was 50% dissolved in 1 hour and completely dissolved in 2 hours, indicating the solution was an effective drain cleaning composition.

The following Examples further illustrate the drain cleaning compositions of the present invention.

EXAMPLE 9

| Ingredients | Percent |
|---|---|
| Ammonium N-2-hydroxyethylimino diacetic acid | .25 |
| Ammonium salt of a sulfated linear primary alcohol ethoxylate | .12 |
| Water | 99.63 |

EXAMPLE 10

| | |
|---|---|
| Monoethanolamine salt of ethylenediamine-tetraacetic acid | 5.0 |
| Monoethanolamine salt of lauryl sulfate | .12 |
| Water | 94.88 |

EXAMPLE 11

| | |
|---|---|
| Diisopropylamine salt of ethylenediamine-tetraacetic acid | .25 |
| Monoethanolamine salt of lauryl sulfate | 15.0 |
| Water | 84.75 |

EXAMPLE 12

| | |
|---|---|
| Diethanolamine salt of ethylenediamine-tetraacetic acid | 5.0 |
| Monoethanolamine salt of a sulfated linear primary alcohol ethoxylate | 15.0 |
| Water | 80.0 |

Inasmuch as the present invention is subject to many variations, modifications, and changes in detail, it is intended that all matter above described or shown in the examples be interpreted as illustrative and not in a limiting sense.

What is claimed is:

1. A drain cleaning composition consisting essentially of:

from about 0.25% to 5%, by weight, of a member selected from the group consisting of an ammonium, alkylamine, hydroxy-alkylamine salt of nitrilotriacetic acid, N-2-hydroxy-ethylimino diacetic acid, an alkylene polyamine polycarboxylic acid, and mixtures thereof;

from about 0.12% to 15%, by weight, of a surfactant selected from the group consisting of an ammonium, alkylamine, or hydroxyalkylamine salt of an anionic surfactant and mixtures thereof, wherein said anionic surfactant is selected from the group consisting of:

lauryl sulfate;

a sulfated linear primary alcohol ethoxylate;

a phosphate ester having the formula $$[R{-}O\ (CH_2CH_2O)_x]_y\overset{O}{\overset{\|}{P}}(OH)_{3-y}$$

where $x$ has a value of 1 to 15 and $y$ has a value of 1 to 2, and R is an alkyl or phenalkyl radical having from 6–150 carbon atoms;

a derivative of sulfo succinic acid;

an alkyl aryl sulfonate;

an alkyl sulfate; and an alkyl ethylene oxide ether sulfate; and up to about 99%, by weight, of water, wherein said alkylamine and hydroxy-alkylamine have a chain length of from 1 to 5 carbon atoms and said composition is substantially free of alkali metal ions.

2. A composition according to claim 1 wherein said anionic surfactant is selected from the group consisting of lauryl sulfate;

a sulfated linear primary alcohol ethoxylate; and a phosphate ester having the formula $$[R-O\ (CH_2CH_2O)_x]_y-\overset{O}{\overset{\|}{P}}(OH)_{3-y}$$

where $x$ has a value of 1 to 15 and $y$ has a value of 1 to 2, and R is an alkyl or phenalkyl radical having from 6–150 carbon atoms.

3. A composition according to claim 1 wherein said alkylene polyamine polycarboxylic acid has the formula $$(HOOCCH_2)_2N-[(CH_2)_xNCH_2COOH]_y-CH_2COOH$$

wherein $x$ and $y$ may independently be from 1 to 7.

4. The composition according to claim 3 wherein said alkylene polyamine polycarboxylic acid has the formula $$(HOOCCH_2)_2N-[(CH_2)_xNCH_2COOH]_y-CH_2COOH$$

wherein $x$ and $y$ may each independently be from 1 to 4.

5. A composition according to claim 4 wherein said anionic surfactant is selected from the group consisting of lauryl sulfate;

an ammonium salt of a sulfated linear primary alcohol ethoxylate; and a phosphate ester having the formula $$[R-O(CH_2CH_2O_x]_y-\overset{O}{\overset{\|}{P}}(OH)_{3-y}$$

where $x$ has a value of 1 to 15 and $y$ has a value of 1 to 2, and R is an alkyl or phenalkyl radical having from 6–150 carbon atoms.

6. A composition according to claim 5 wherein said member is present from about 0.50% to about 3.0%, by weight; said salt of said anionic surfactant is present from about 0.50% to about 5.0%, by weight; and said composition additionally contains up to about 10%, by weight, of corrosion inhibitor selected from the group consisting of an ammonium, alkylamine or hydroxyalkylamine salt of thioglycolic acid, and mixtures thereof, wherein said alkyl radical has from 1 to 5 carbon atoms.

7. A composition according to claim 6 wherein said member is selected from the group consisting of an ammonium, alkylamine, or hydroxyalkylamine salt of ethylenediaminetetraacetic acid, nitrilotriacetic acid, N-2-hydroxyethylimino diacetic acid, or mixtures thereof, and said corrosion inhibitor is present from about 0.12% to about 5.0%, by weight.

8. A composition according to claim 7 wherein said composition consists essentially of, by weight:

about 1.5% of said member;

about 1.7% of said salt of said anionic surfactant;

about 1.0% of said corrosion inhibitor and up to about 95.8% water.

* * * * *